US009721550B2

(12) United States Patent
Manrique

(10) Patent No.: US 9,721,550 B2
(45) Date of Patent: Aug. 1, 2017

(54) ERGONOMIC SUPPORT AND CONTROL PAD FOR A STRINGED MUSICAL INSTRUMENT

(71) Applicant: Daniel Manrique, San Jose, CA (US)

(72) Inventor: Daniel Manrique, San Jose, CA (US)

( * ) Notice: Subject to any disclaimer, the term of this patent is extended or adjusted under 35 U.S.C. 154(b) by 0 days.

(21) Appl. No.: 15/166,095

(22) Filed: May 26, 2016

(65) Prior Publication Data

US 2016/0351176 A1 Dec. 1, 2016

Related U.S. Application Data

(60) Provisional application No. 62/167,154, filed on May 27, 2015.

(51) Int. Cl.

| | |
|---|---|
| ***G10G 5/00*** | (2006.01) |
| ***G10D 1/02*** | (2006.01) |
| ***G10D 1/08*** | (2006.01) |
| ***G10D 3/00*** | (2006.01) |
| ***G10D 3/18*** | (2006.01) |

(52) U.S. Cl.
CPC ..... *G10G 5/005* (2013.01); *G10D 3/18* (2013.01); *G10D 1/08* (2013.01)

(58) Field of Classification Search
CPC ..... G10G 5/005; G10D 1/08; G10D 3/18
USPC ..... 84/327, 280
See application file for complete search history.

(56) References Cited

U.S. PATENT DOCUMENTS

| | | | | |
|---|---|---|---|---|
| 1,945,162 | A * | 1/1934 | Rasmussen | G10G 5/005 84/327 |
| 2,478,537 | A * | 8/1949 | Krause | G10D 3/18 84/280 |
| 2,746,336 | A * | 5/1956 | Bisharat | G10D 3/18 84/280 |
| 2,814,229 | A * | 11/1957 | Vaccaro | G10D 3/003 84/280 |
| 3,727,509 | A * | 4/1973 | Henkle | G10D 3/18 84/278 |
| 3,955,461 | A * | 5/1976 | Ivie | G10G 5/00 84/327 |
| 3,979,993 | A * | 9/1976 | Proctor | G10G 5/005 84/327 |
| 4,951,541 | A * | 8/1990 | McMillan | G10D 3/18 84/280 |

(Continued)

*Primary Examiner* — David Warren
*Assistant Examiner* — Christina Schreiber
(74) *Attorney, Agent, or Firm* — GSS Law Group

(57) ABSTRACT

An instrument support adapted for placement between a musical instrument and a musician's body includes a flexible pad joined to a flexible flap. The instrument support has a roughly textured side for resting against a musician's clothing without slipping and a smoothly textured side for contacting the instrument. A transverse ridge extending from an approximately flat upper surface of the pad establishes an accurately repeatable position reference for playing the instrument and prevents the instrument from slipping from the pad. The smoothly textured top of the pad establishes close contact with a smooth surface on the instrument and may establish stiction or suction between the pad and the instrument. An end of the flap may optionally be tucked around a belt worn by a musician to hold the pad in a preferred position against the musician's chosen leg. Some embodiments include a belt clip attached the flap.

18 Claims, 7 Drawing Sheets

(56) References Cited

U.S. PATENT DOCUMENTS 4,966,062 A * 10/1990 Driggers ..... G10G 5/005 224/910
5,208,409 A * 5/1993 Roulet ..... G10D 3/18 84/278
5,315,910 A * 5/1994 Soupios ..... G10D 1/085 84/263
5,388,492 A * 2/1995 Olson ..... G10G 5/005 224/910
5,616,874 A * 4/1997 Kraus ..... G10G 5/005 84/327
5,817,961 A * 10/1998 Beck ..... G10G 5/005 84/327
D410,669 S * 6/1999 Hamre ..... 84/327
6,005,175 A * 12/1999 Johnson ..... G10D 3/18 84/327
6,031,167 A * 2/2000 Gaston ..... G10G 5/005 84/327
6,189,158 B1 * 2/2001 Lehoux ..... A45C 13/38 2/1
6,252,150 B1 * 6/2001 Johnson ..... G10G 5/005 84/327
6,259,007 B1 * 7/2001 Stuart ..... G10G 5/005 84/281
6,528,712 B2 * 3/2003 Lehoux ..... G10G 5/005 84/327
6,576,823 B1 * 6/2003 Wise, Jr. ..... G10G 5/005 84/327
6,624,346 B2 * 9/2003 Standish ..... G10G 5/005 84/280
7,205,468 B1 * 4/2007 Johnson ..... G10G 5/005 84/327
7,420,108 B1 * 9/2008 Block ..... G10G 5/005 84/327
7,732,689 B1 * 6/2010 Jiang ..... G10G 5/005 248/443
8,618,393 B1 * 12/2013 Peters ..... G10D 1/08 84/327
8,901,403 B2 * 12/2014 Barnett ..... G10G 5/005 84/327
9,495,945 B1 * 11/2016 George ..... G10G 5/005
2003/0217635 A1 * 11/2003 Christou ..... G10G 5/005 84/327
2007/0193431 A1 * 8/2007 Sweeney ..... G10G 5/005 84/327
2007/0289430 A1 * 12/2007 Gallagher ..... G10G 5/005 84/327
2010/0319515 A1 * 12/2010 Cadd ..... G10D 3/18 84/327
2011/0000358 A1 * 1/2011 Cheng ..... G10D 3/18 84/328
2016/0351176 A1 * 12/2016 Manrique ..... G10G 5/005

* cited by examiner

ERGONOMIC SUPPORT AND CONTROL PAD FOR A STRINGED MUSICAL INSTRUMENT

CROSS REFERENCE

This application claims priority to U.S. Provisional Patent Application No. 62/167,154, titled "Ergonomic Support and Control Pad for a Stringed Musical Instrument", filed May 27, 2015, incorporated herein by reference in its entirety.

FIELD OF THE INVENTION

Embodiments are related to pads or cushions for supporting a stringed musical instrument against a musician's body.

BACKGROUND

A seated musician may rest a guitar or other stringed instrument against a leg while playing the instrument. Sound quality from the instrument and the quality of a musician's performance may be influenced by the position of the instrument. For example, a musician may find that performance quality changes when seated on a tall stool compared to a low bench, possibly because of a greater tendency for the instrument to slide from a preferred playing position in one seating position compared to another. Variations in sound and/or performance quality may be influenced by a musician's choice of clothing, possibly because some clothing fabrics grip an instrument being played more securely than others. Some fabrics have a greater dampening effect than others on vibrations from the instrument. Holding the instrument firmly enough to prevent the instrument from slipping may dampen sound output, may interfere with the musician's preferred positioning of the instrument, or may interfere with the musician's preferred movements for playing the instrument. Not holding firmly enough may allow the instrument to slip, possibly resulting in poor control of the instrument, for example missed or incorrect notes. Unintended changes in instrument position from one performance to another may make it more difficult to play an instrument with consistent tempo, tone, and accuracy.

SUMMARY

An example of an apparatus embodiment includes a support for a musical instrument. The support includes a flexible pad, a flexible flap joined to the flexible pad, and a ridge extending transversely across the flexible pad. A top surface of the flexible pad is separated from a top surface of the flexible flap. The ridge extends outward from the top surface of the flexible pad.

The example of an apparatus embodiment may optionally further include any the following, individually or in any combination: a thickness dimension of the flexible flap less than twenty percent of a thickness dimension of the flexible pad; the flexible flap integrally formed with the flexible pad; the flexible pad and the flexible flap have a same width; the ridge integrally formed with the flexible pad; the flexible pad extends less than half way along a length of a side wall of the musical instrument when the musical instrument is in contact with the ridge and the flexible pad; a belt hook attached to the flexible flap; and the belt hook attached to an end of the flexible flap opposite the flexible pad.

An example of a method embodiment includes placing an instrument support against a top side of a seated musician's leg and resting a musical instrument against the instrument support with a first side of the musical instrument in contact with a top surface of a flexible pad on the instrument support and a second side of the musical instrument adjacent said the side in contact with a transverse ridge on the top surface of the flexible pad.

DESCRIPTION

An embodiment includes a flexible instrument support for resting a musical instrument against a musician's body, for example against a seated musician's leg. Embodiments provide a repeatable, stable, nonslip position reference for holding a musical instrument while playing the instrument in different seated playing positions. An instrument support embodiment may enable an instrument to be played with improved sound quality, improved performance accuracy, better freedom of motion for improved expression of play, and improved comfort for the musician, compared to playing the instrument without an instrument support embodiment. Embodiments reduce unwanted slippage of an instrument held close to a musician's body and may reduce risk of damage to the instrument or injury to musician.

An instrument support may help a person learn and establish correct instrument position and body posture for playing a musical instrument. A skilled musician may play with greater technical skill and freedom of expression when using an embodiment to position and support a stringed instrument during play. Embodiments are effective for establishing and maintaining a preferred tilt angle of an instrument, for example by rotating the body of the instrument relative to the pad, selecting which part of an instrument rests against the pad, or by adjusting a position of the pad against a musician's body. Embodiments formed with a back surface and a top surface that are not parallel to one another or with a curved back surface may induce a preferred bias in a tilt angle of an instrument. Instrument support embodiments are readily adaptable to different sizes and shapes of musical instruments including, but not limited to, guitars, banjos, mandolins, and dulcimers, and may be used to support an instrument against a person's right leg, left leg, or both legs at a musician's discretion.

Figure 1:
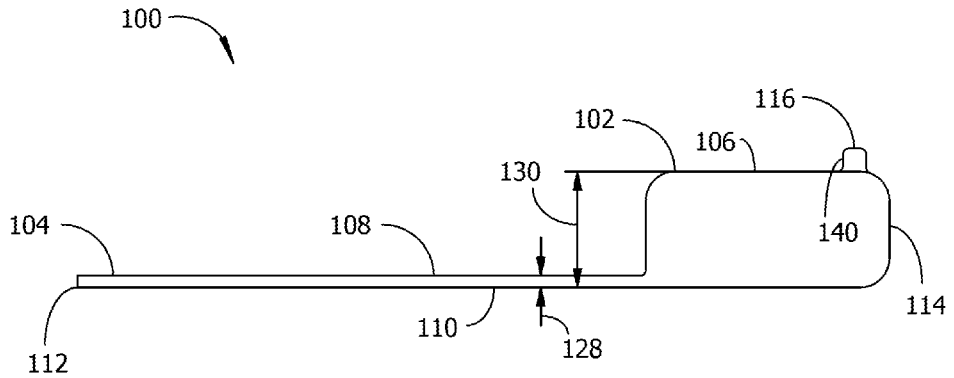
FIG. 1 shows a view toward a right side of an example of an instrument support having an optional flexible flap.
Figure 2:
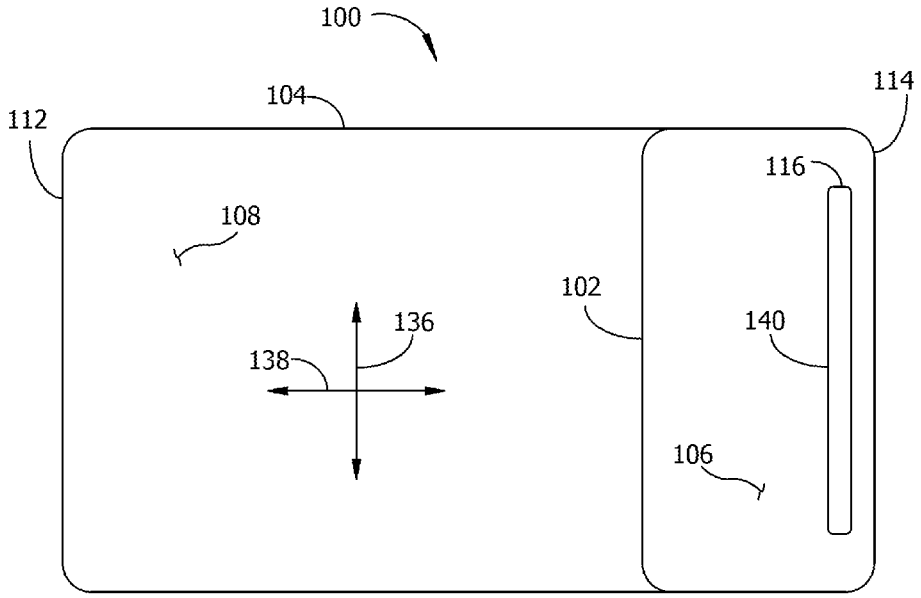
FIG. 2 shows a view toward a top side of the example of an instrument support from FIG. 1.

An example of an instrument support embodiment is shown toward a right side in FIG. 1 and toward a top surface in FIG. 2. An instrument support 100 includes a flexible pad 102 joined to an optional flexible flap 104. A back surface 110 of the instrument support 100 includes a back surface of the flap 104 and a back surface of the pad 102. A musical instrument resting against the pad preferably contacts the top surface 106 of the pad 102 and a side 140 of a ridge 116 on the pad. The side 140 of the ridge and the top surface 106 of the pad define a reference position for placement of the instrument on the instrument support 100. The top surface 106 of the pad 102 is preferably elevated above and separate from the top surface 108 of the flap 104, for example by making a thickness dimension 128 of the flap less than about twenty percent of the thickens dimension 130 of the pad. The top surface 106 may optionally be formed with a smooth surface for establishing a stiction grip, or possibly a light suction grip, against a smooth instrument surface. The ridge 116 extends in a transverse direction 136 across the pad and outward from the top surface 106 of the pad 102. The ridge 116 prevents an instrument resting on the pad 102 from slipping off the upper surface 106 of the pad.

Both the flap and pad may be made from flexible materials to permit the flap and pad to be curved to conform to a part of a musician's body. The compressibility and flexibility of the pad 102 enable the top surface 106 of the pad to conform to the surface of the instrument to establish a nonslip grip on the instrument. During use, an embodiment 100 may be placed against one of the musician's legs with the musician seated and the back surface 110 resting on the chosen leg between a knee joint and a hip joint. The instrument support 100 may be arranged with a first end 112 closest to the musician's torso and a second end 114 closest to the musician's knee. Alternatively, a musician may turn the instrument support 100 end-for-end so that the second end 114 is closer to the musician's torso than the first end 112. The back surface 110 preferably has a rough surface texture for gripping the fabric of the musician's clothing. The flexible flap increases the surface area available for gripping the musician's clothing to prevent the pad, flap, and instrument from slipping away from a preferred position against the musician's body and provides a convenient handgrip for pulling the pad and instrument together to adjust a playing position of the instrument.

In some embodiments of an instrument support 100, the pad 102 and flap 104 are integrally formed from one sheet of flexible flat stock such as synthetic leather, natural leather, felt, or woven fabric. Alternatively, the flap and pad may be formed from separate pieces joined together by stitching, gluing, fusing, or riveting. A pad may be formed by rolling and/or folding layers of flat stock. Alternatively, the pad may be formed from a resilient, compressible, flexible polymer foam block joined to the flap, or by a foam block wrapped in flexible sheet stock having an end extending outward from the wrapped block to form the flap. The ridge 116 on the top surface 106 of the pad 102 may be formed integrally with the pad or may alternatively be formed as a separate piece and strongly affixed to the pad. The ridge may optionally comprise a layer of material over an elongate stiffener made from a flexible material, for example but not limited to a flexible polymer material, spring steel, aluminum, copper, or brass, or an insert formed from the same material used to cover the pad. The ridge 116 preferably extends far enough above the top surface 106 of the pad 102 to stop the musical instrument from sliding off the pad during play in different seating positions. Materials for the flap and pad are preferably permeable to water vapor and may optionally be made from materials which may be washed or laundered without damage to the instrument support 100.

The flap 104 may optionally be formed long enough to be tucked under a belt or waistband worn by a musician to prevent the instrument support 100 slipping along the musician's leg. The flap 104 may optionally be formed long enough that a hand may easily grip an end of the flap while an instrument is resting on the pad. For example, a musician may reposition an instrument resting on the pad by pulling on the end of the flap or by pushing the instrument and pad away from the torso.

Figure 3:
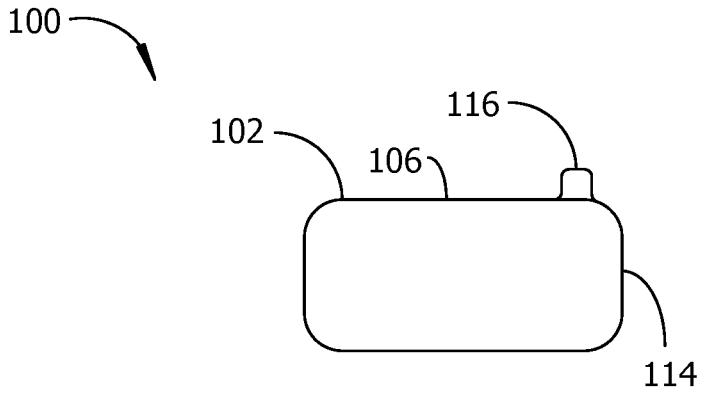
FIG. 3 shows a view toward a right side of an alternative embodiment of an instrument support pad which omits the optional flexible flap from the embodiment of FIGS. 1-2.
Figure 4:
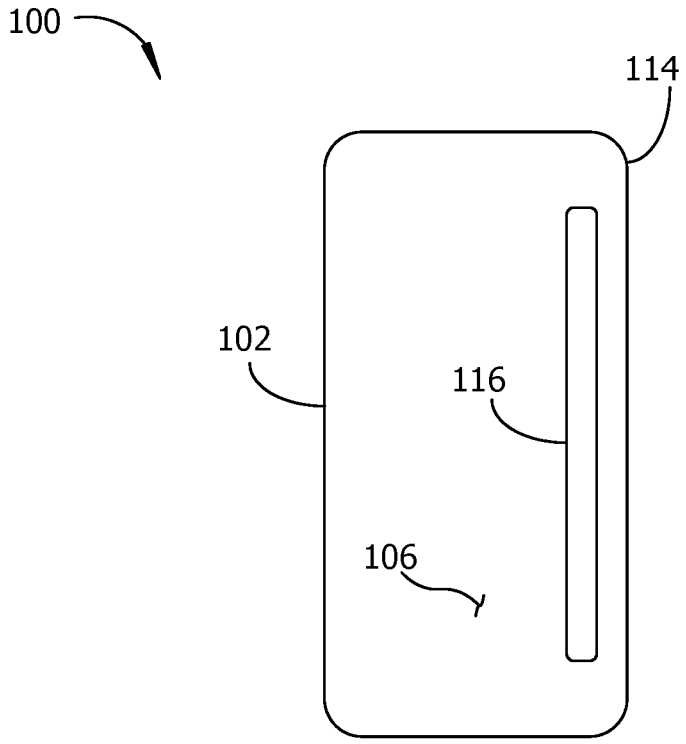
FIG. 4 shows a view toward the top side of the example of an instrument support from FIG. 3.

An embodiment 100 may optionally be formed without the flap 104 from the preceding examples, as shown in the examples of FIGS. 3-4. The pad 102 and ridge 116 in the examples of FIGS. 3-4 are similar to the examples of a pad 102 and ridge 116 in FIGS. 1-2.

Figure 5:
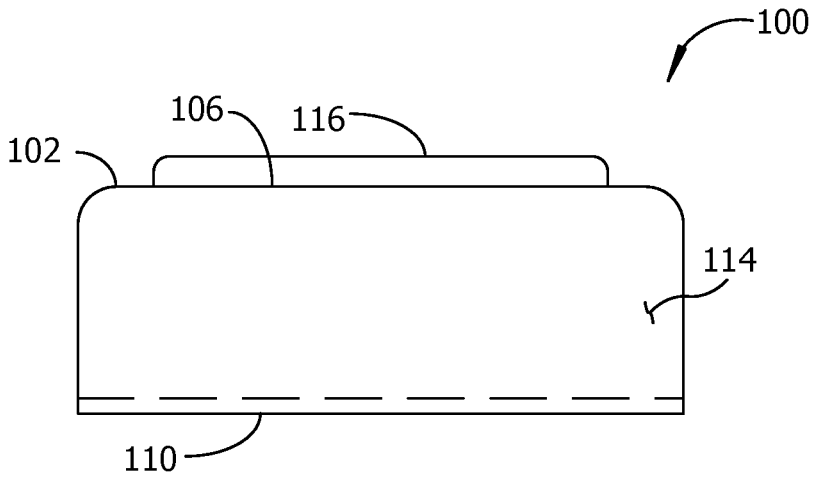
FIG. 5 shows a view toward an end of the previous examples of an instrument support.
Figure 6:
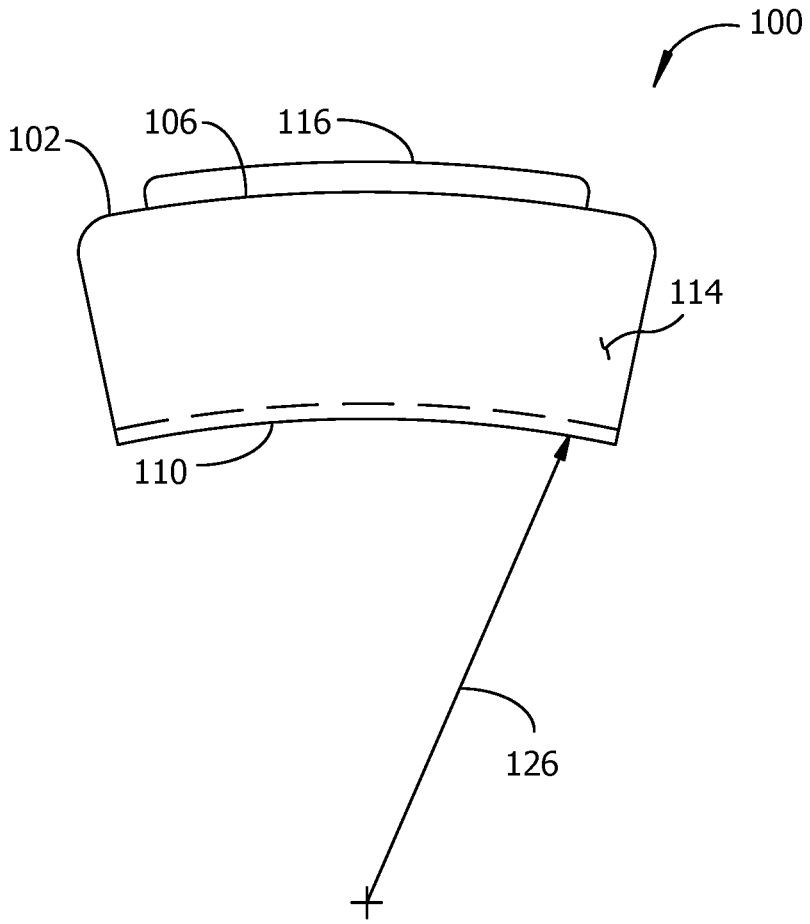
FIG. 6 shows an alternative view toward the end of the previous examples of an instrument support, with the instrument support curved to conform to a rounded surface such as a musician's leg.

The pad 102 in any of the preceding examples is preferably flexible and may curve to conform to the shape of an underlying support surface such as a musician's leg. In a view toward the second end 114 of the pad in FIG. 5, the back surface 110 of the example of a flexible pad 102 is approximately flat. In FIG. 6, the example of a back surface 110 is curved with a radius of curvature 126, with other parts (102, 106, 116) curved to somewhat larger radii. The curved shape assumed by the flexible flap and flexible pad during use may form with more than one radius of curvature or with different amounts of deflection at different locations.

A pad 102 may optionally include materials that retain a curved shape after conforming to a curved surface. In an example of an embodiment, the pad and flap may be made from deer leather having a smoothly textured side for top surfaces (106, 108) on the instrument support 100 and a roughly textured side for the back surface 110. A pad and flap may alternatively be made from resilient materials that restore the back surface 110 of the instrument pad 100 to the approximately flat condition suggested in FIG. 5 after removing the instrument from the pad.

Figure 7:
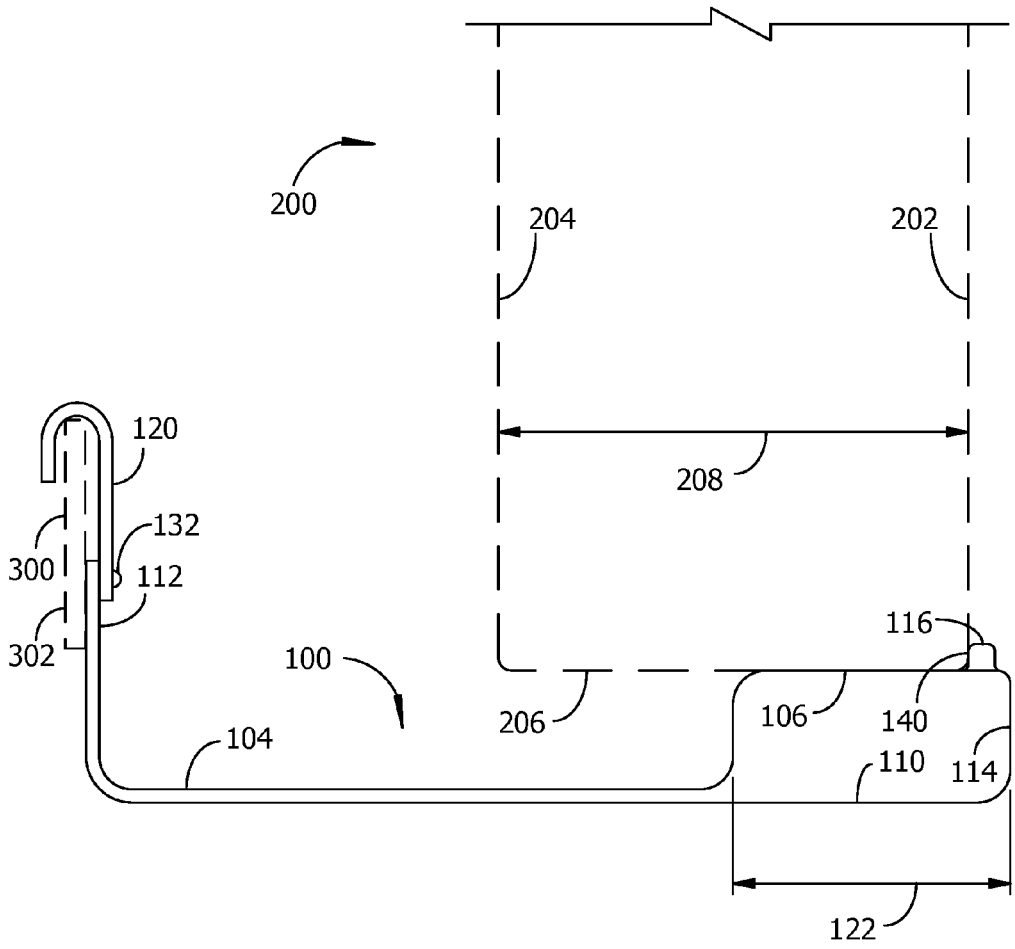
FIG. 7 shows a partial side view of an example of a musical instrument resting against an embodiment having an optional belt clip attached near an end of the optional flap, and further showing the belt clip suspended from an example of a waistband or belt.

FIG. 7 illustrates an example of an embodiment 100 supporting a musical instrument 200. A portion of a musical instrument 200, shown in dashed lines, may represent part of the body of a guitar having a back side 204, a front side 202 opposite the back side, and a side wall 206 joining the back side to the front side. On a guitar or similar instrument, the front side 202 may correspond to the soundboard of the instrument. The back side 204 may be closest to the musician's torso while the instrument is being played, with the side wall 206 in contact with the top surface 106 of the pad and the front side 202 in contact with the side 140 of the ridge 116. An instrument may alternatively be positioned with the back side 204 resting on the top surface 106 of the pad and the side wall 206 in contact with the side 140 of the ridge 116. Embodiments of the instrument support 100 are suitable for either instrument orientation. Placing adjacent surfaces of the instrument in contact with the top surface of the pad and the side of the ridge establishes a repeatable, stable, nonslip position for playing the instrument.

FIG. 7 further illustrates an example of a length dimension 122 of the top surface 106 of the pad 102 that is less than about half a height dimension 208 of the side wall 206 of the instrument 200, allowing part of the instrument to overhang the pad. The length dimension 122 of the pad 122 is preferably measured in a length direction 138 for the instrument support 100. A width dimension of the pad and a width dimension of the flap, both measured in a width direction 136 (ref. FIG. 1), may optionally be the same. Limiting contact between the instrument and pad to about half the height of the instrument's side wall may reduce a dampening effect of the pad on sound vibrations produced by the instrument, possibly improving resonance, frequency range, loudness, attack, sustain, decay, or other aspects of sound quality compared to resting the instrument directly against the musician's clothing.

The instrument support 100 may optionally be fitted with a belt hook 120 attached near the first end 112 of the flap 104. The optional belt hook 120 may be used to suspend the flap 104 and pad 106 from a belt 300 worn by the musician. As suggested in the example of FIG. 7, the belt hook 120 may be suspended from a waistband 302 instead of, or alternatively in addition to, being suspended from a belt 300. The waistband 302 may be part of trousers, a skirt, or another garment worn by a musician. The belt hook 120 may be joined to the flap 104 by a fastener 132. Examples of a fastener 132 include, but are not limited to, stitching, a rivet, a bolt, a nail, and a screw. The clip may alternatively be joined to the flap by adhesive, crimping, or fusion by heat or pressure.

Figure 8:
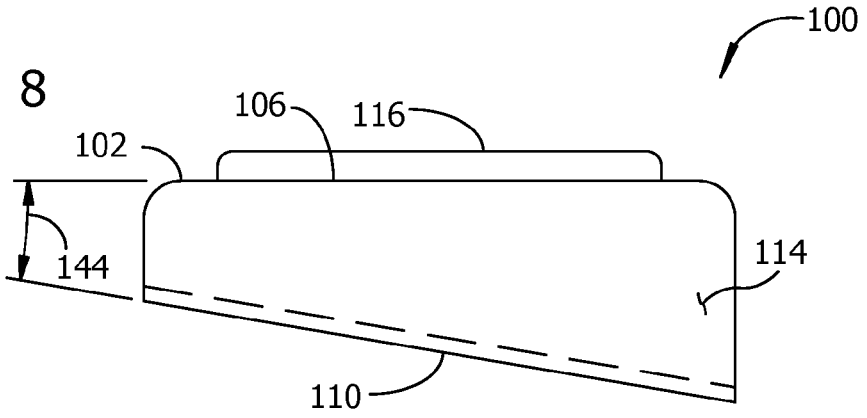
FIG. 8 shows a view toward an end of an alternative embodiment of a pad having a top surface and a bottom surface that are not parallel to one another.

An example of an alternative embodiment of a pad 102 is shown in FIG. 8. In the example of FIG. 8, the top surface 106 of the pad 102 is formed to be approximately flat when the pad is resting on a flat, hard surface, with a ridge extending outward from the top surface. The back surface 110 is also approximately flat, but is disposed at a nonzero acute angle 144 relative to the top surface so that the top surface and back surface are not parallel to one another.

Figure 9:
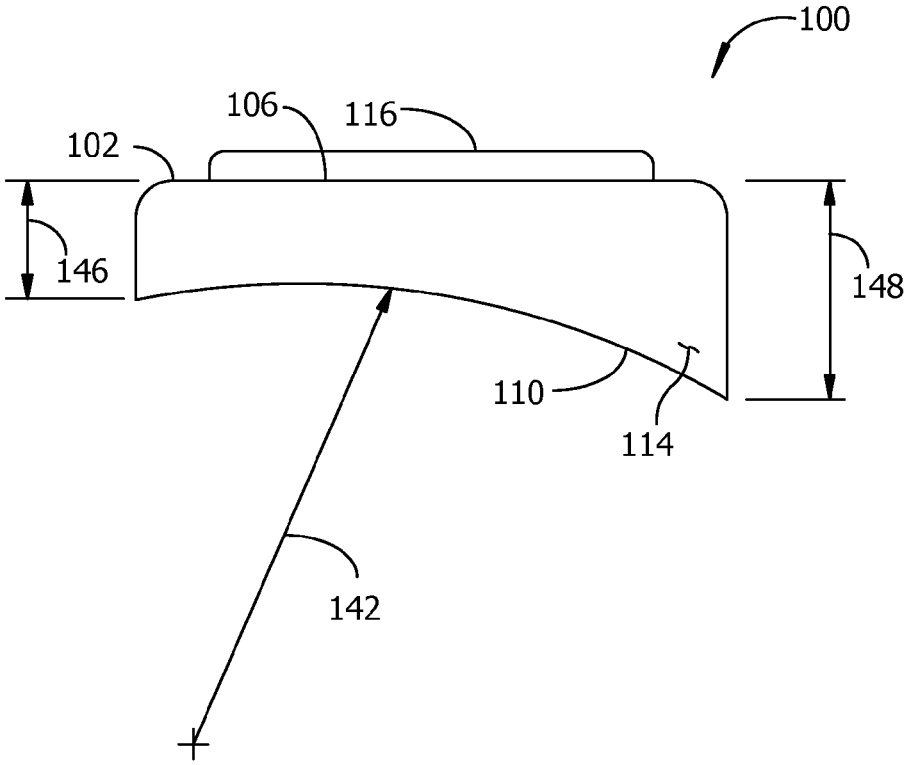
FIG. 9 shows a view toward an end of an alternative embodiment of a pad have an approximately flat top surface and a bottom surface formed with curved surface.

An example of another alternative embodiment of a pad 102 is shown in FIG. 9. In the example of FIG. 9, a first side of the pad 102 is formed with a thickness dimension 146, and a second side opposite the first side is formed with a different, larger thickness dimension 148. The difference in the thicknesses of the opposite sides of the pad are preferably substantial, forming the pad into a truncated wedge. As with other embodiments, the top surface 106 is formed to be approximately flat when the pad is resting on a flat surface, but the back surface of the pad 102 is formed into a curved shape. In the example of FIG. 9, the back surface is formed into an arcuate profile having a radius of curvature 142.

Figure 10:
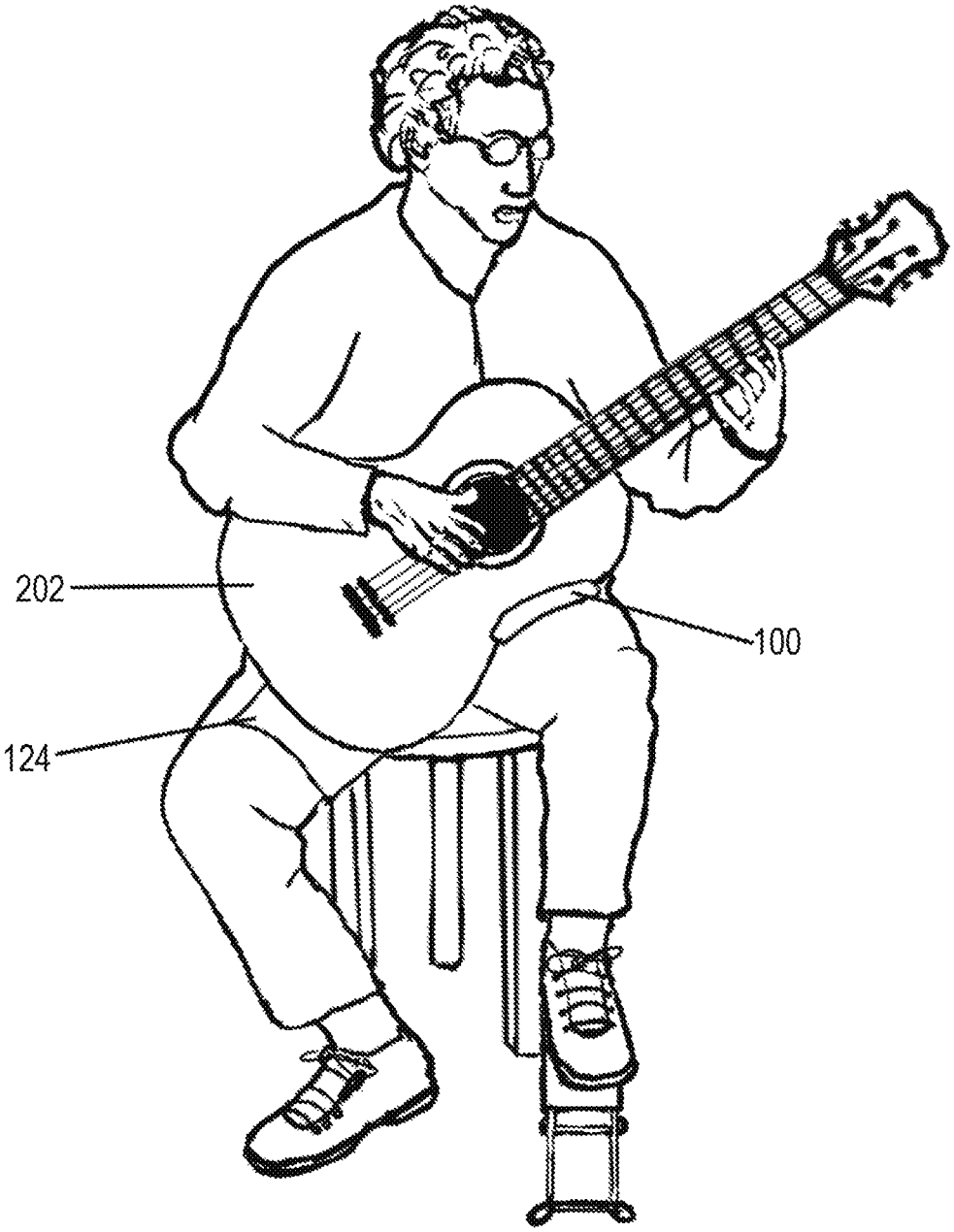
FIG. 10 shows an example of a guitar resting on an instrument support placed on a musician's left leg, and an optional end pad placed on the musician's right leg.
Figure 11:
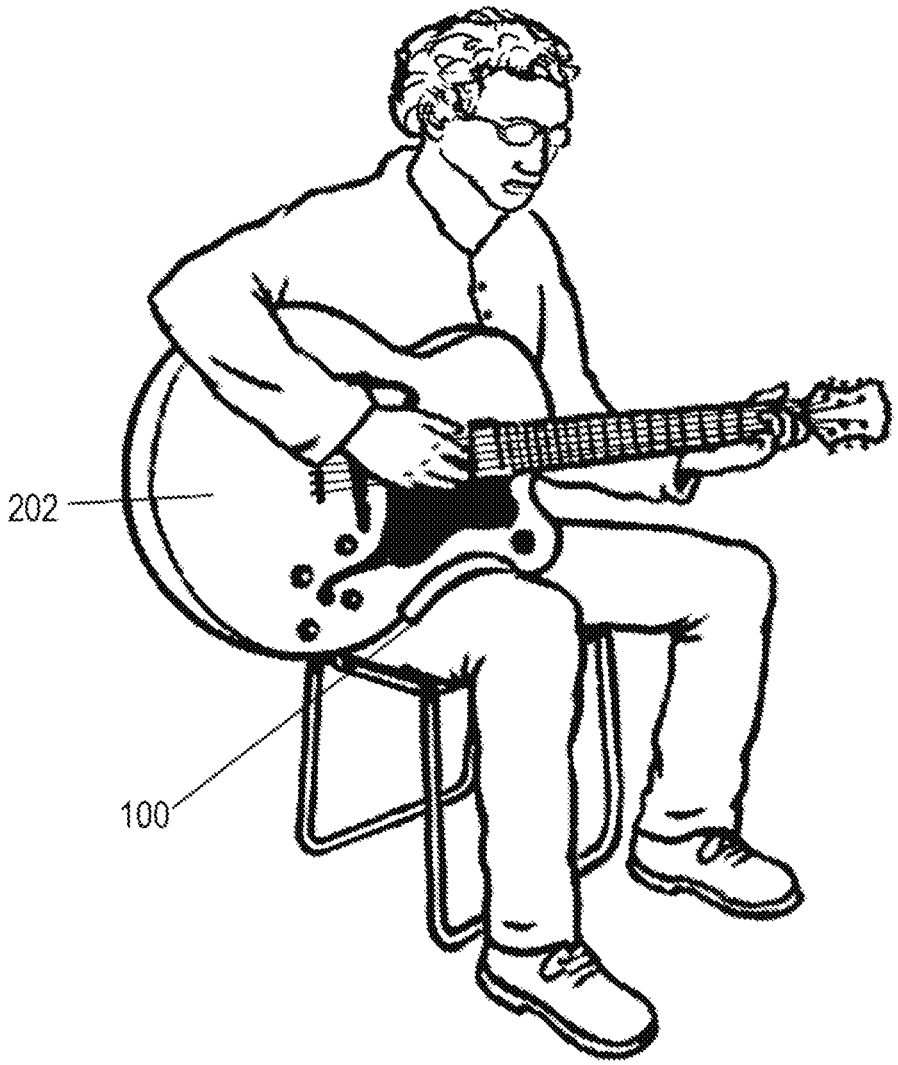
FIG. 11 shows an example of a guitar resting against an embodiment placed on a musician's right leg.

FIGS. 10-11 illustrate examples of an embodiment in use by a musician. In the example of FIG. 10, an instrument support 100 is interposed between a guitar and the musician's left leg with the front side 202 and side wall of the guitar contacting the ridge and top surface of the pad on the instrument support (ref. FIG. 5). An optional end pad 124 may be interposed between an end of the guitar and the musician's right leg. The end pad may comprise a sheet of material with a rough-textured side and a smooth textured side as for the instrument support 100. In the example of FIG. 11, the instrument is shown resting on the instrument support 100 on the musician's right leg, without the use of the optional end pad.

An example of a method embodiment 100 includes:

placing an instrument support 100 on a seated musician's leg; and resting a musical instrument 200 against the instrument support 100 with a first side 206 of the musical instrument in contact with a top surface 106 of a flexible pad 102 on the instrument support 100 and a second side 204 of the musical instrument adjacent the first side 206 in contact with a transverse ridge 116 on the top surface 106 of the flexible pad 102.

The example of a method embodiment may optionally include any of the following, individually or in any combination:

conforming a back surface 110 of the instrument support 100 to the musician's leg;

conforming the top surface 106 of the flexible pad 100 to the first side 206 of the musical instrument 200;

interposing an end pad 124 between the musical instrument 200 and an other leg;

suspending a belt hook 120 attached to a flexible flap 104 extending from the flexible pad 102 from a belt 300 worn by the musician;

suspending a belt hook 120 attached to the flexible flap 104 from a waistband 302 of trousers or a waistband of a skirt worn by the musician; and tucking an end of the flexible flap 104 around the belt 300.

Unless expressly stated otherwise herein, ordinary terms have their corresponding ordinary meanings within the respective contexts of their presentations, and ordinary terms of art have their corresponding regular meanings.

What is claimed is:

1. A support for a musical instrument, comprising:

a back surface formed as a flat surface extending in a length direction from a first end of said support to a second end of said support;

a flexible pad comprising:

a top surface formed as a flat surface having a longest dimension extending in a transverse direction;

a ridge extending outward from said top surface with a longest dimension of said ridge extending in said transverse direction across said top surface;

a first side extending from said back surface to said top surface at said second end of said support;

a second side adjoining said top surface opposite said first side; and a flexible flap joined to said second side of said flexible pad with said flexible flap extending in said length direction to said first end of said support and with said second side of said flexible pad interposed between a top surface of said flexible flap and said top surface of said flexible pad.

2. The support of claim 1, further comprising a belt hook attached to said flexible flap.

3. The support of claim 2, wherein said belt hook is attached to an end of said flexible flap opposite said flexible pad.

4. The support of claim 1, wherein a thickness dimension of said flexible flap is less than twenty percent of a thickness dimension of said flexible pad.

5. The support of claim 1, wherein said flexible flap is integrally formed with said flexible pad.

6. The support of claim 1, wherein said flexible pad and said flexible flap have a same dimension in said transverse direction.

7. The support of claim 1, wherein said ridge is integrally formed with said flexible pad.

8. The support of claim 1, wherein said flexible pad has a length dimension extending less than half way along a length of a side wall of said musical instrument when said musical instrument is in contact with said ridge and said top surface of said flexible pad.

9. The support of claim 1, wherein said top surface of said flexible pad is formed at a nonzero acute angle to said back surface.

10. The support of claim 1, wherein said back surface is formed with an arcuate profile.

11. The support of claim 1, said flexible pad further comprising:

a third side joined to said first side, said second side, and said top side of said flexible pad; and a fourth side joined to said top side of said flexible pad opposite said third side, wherein a thickness dimension of said third side of said flexible pad differs from a thickness dimension of said fourth side.

12. A method, comprising:

placing an instrument support against a top side of a seated musician's leg; and resting a musical instrument against said instrument support with a first side of said musical instrument in contact with a top surface of a flexible pad on said instrument support and a second side of said musical instrument adjacent said first side in contact with a transverse ridge on said top surface of said flexible pad, wherein said instrument pad is positioned with said flexible pad interposed between said top surface in contact with said musical instrument and a flexible flap extending from said flexible pad.

13. The method of claim 12, further comprising conforming a back surface of said instrument support to said musician's leg.

14. The method of claim 12, further comprising conforming said top surface of said flexible pad to said first side of said musical instrument.

15. The method of claim 12, further comprising interposing an end pad between said musical instrument and said musician's other leg.

16. The method of claim 12, further comprising suspending a belt hook attached to a said flexible flap from a belt worn by said musician.

17. The method of claim 12, further comprising suspending a belt hook attached to said flexible flap from a waistband worn by said musician.

18. The method of claim 12, further comprising tucking an end of said flexible flap around a belt worn by said musician.

* * * * *